US010718207B2

(12) United States Patent
Gajic et al.

(10) Patent No.: US 10,718,207 B2
(45) Date of Patent: Jul. 21, 2020

(54) POWER SAVING TELEMETRY SYSTEMS AND METHODS

(71) Applicant: NABORS DRILLING TECHNOLOGIES USA, INC., Houston, TX (US)

(72) Inventors: Bosko Gajic, Kingwood, TX (US); Keith Batke, Klein, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

(21) Appl. No.: 16/185,157

(22) Filed: Nov. 9, 2018

(65) Prior Publication Data

US 2020/0149392 A1 May 14, 2020

(51) Int. Cl.
*E21B 47/13* (2012.01)

(52) U.S. Cl.
CPC ..... *E21B 47/13* (2020.05)

(58) Field of Classification Search
None
See application file for complete search history.

(56) References Cited

U.S. PATENT DOCUMENTS

| | | | | |
|---|---|---|---|---|
| 9,062,537 | B1 * | 6/2015 | Holt | E21B 44/00 |
| 9,810,056 | B2 | 11/2017 | Batke et al. | |
| 2003/0026263 | A1 * | 2/2003 | Taunton | H04L 27/2614 370/395.1 |
| 2016/0130937 | A1 * | 5/2016 | Logan | E21B 47/18 367/83 |

* cited by examiner

*Primary Examiner* — Curtis A Kuntz
*Assistant Examiner* — Jerold B Murphy
(74) *Attorney, Agent, or Firm* — Haynes and Boone, LLP

(57) ABSTRACT

Apparatuses, methods, and systems are described herein for transmission of measurement while drilling (MWD) data from a MWD tool to a receiver. Such apparatuses, methods, and systems may modify MWD data to allow for transmission of the modified MWD data in a manner that conserves electrical power of the MWD tool. For example, the MWD data can be modified to allow for effectively slower transmission of the data while adhering to existing transmission settings. Such a technique allows for MWD data to be conveyed in an electrically efficient manner, reducing maintenance and recharging requirements of the MWD tool.

20 Claims, 5 Drawing Sheets

POWER SAVING TELEMETRY SYSTEMS AND METHODS

FIELD OF THE DISCLOSURE

The present apparatus, methods, and systems relate generally to drilling and particularly to improved communication techniques for providing measurement while drilling (MWD) data.

BACKGROUND OF THE DISCLOSURE

Underground drilling involves drilling a borehole through a formation deep in the Earth using a drill bit connected to a drill string. The drill bit is typically mounted on the lower end of the drill string as part of a bottom-hole assembly (BHA) and is rotated by rotating the drill string at the surface and/or by actuation of down-hole motors or turbines. A BHA may include a variety of sensors used to monitor various down-hole conditions—such as pressure, spatial orientation, temperature, or gamma ray count—that are encountered while drilling. A typical BHA will also include a telemetry system that processes signals from these sensors and transmits data to the surface. The drilling operations may be guided through MWD data obtained from the BHA. The MWD data may be obtained by the BHA and transmitted to the surface. The MWD data can then be used to understand the formations and make plans on completion, sidetracking, abandoning, further drilling, etc.

Current MWD telemetry systems require a transmitter (typically on the BHA) and a receiver (e.g., a computer at rig with attached hardware) to have matching settings in order to engage in transmission of telemetry data. Accordingly, the settings of the transmitter on the BHA typically cannot be modified without receiving a downlinked command from the rig site. Modification of settings without the transmitter receiving the downlinked command may result in lost connection if the receiver does not recognize the change in settings. Furthermore, existing telemetry systems, especially electromagnetic (EM) based telemetry, are generally configured to transmit at higher data rates. Such higher data rates will consume more power, decreasing endurance of the BHA.

However, MWD tools are typically battery powered and can only store finite energy. Thus, improved telemetry techniques that allow for conservation of battery life and, thus, increased time before recharge, are needed.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
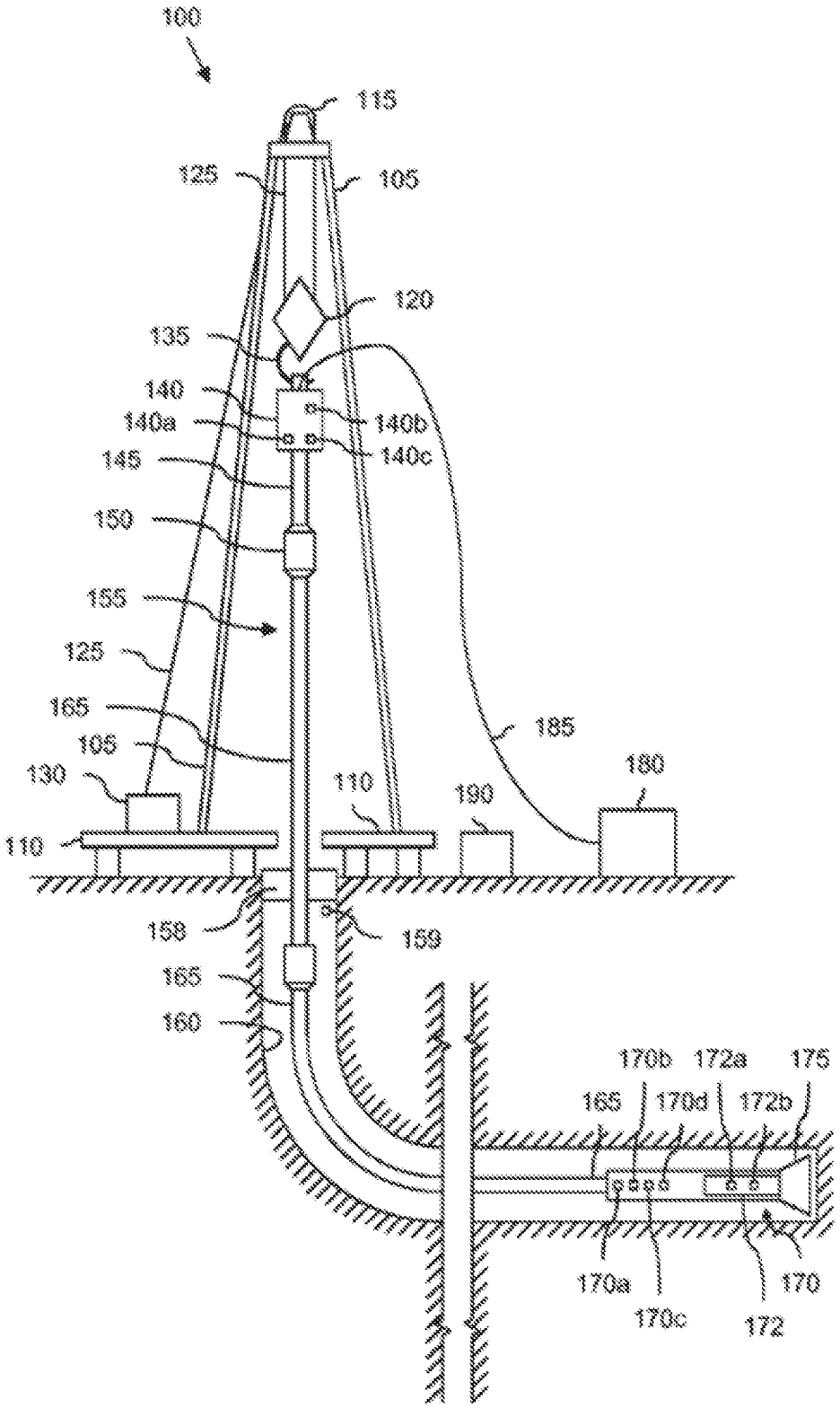
FIG. 1 is a schematic of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

MWD data are communicated between a MWD communicator and a rig communicator. Typically, a BHA generates MWD data through one or more sensors of the BHA and transmits the MWD data from a transmitter (e.g., a component of the MWD communicator) to a receiver (e.g., a component of the rig communicator) of the rig. Conventional MWD data transmission techniques are directed to faster data transmission. However, transmitting MWD data through EM based telemetry typically utilizes a large amount of power. Furthermore, the MWD communicator and rig communicator typically require regular and continuous data communications to maintain a connection and, thus, prevent disconnection between the MWD communicator and the rig communicator.

This disclosure provides apparatuses, systems, and methods for improved transmission of MWD data by modifying MWD data with time between symbols (TBS) to slow down telemetry transmission and conserve battery life (or other power usage) of the BHA. Modifying the MWD data with TBS can increase the time of transmission of MWD data while conserving battery or otherwise minimizing power usage. Furthermore, such MWD data modified with TBS may decrease the amount of data communications needed to simply maintain a connection and, thus, decrease the amount of superfluous data transmitted.

Referring to FIG. 1, illustrated is a schematic view of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

The apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel out and reel in the drilling line 125 to cause the traveling block 120 to be lowered and raised relative to the rig floor 110. The other end of the drilling line 125, known as a dead line anchor, is anchored to a fixed position, possibly near the drawworks 130 or elsewhere on the rig.

A hook 135 is attached to the bottom of the traveling block 120. A top drive 140 is suspended from the hook 135. A quill 145 extending from the top drive 140 is attached to a saver sub 150, which is attached to a drill string 155 suspended within a wellbore 160. Alternatively, the quill 145 may be attached to the drill string 155 directly. It should be understood that other conventional techniques for arranging a rig do not require a drilling line, and these are included in the scope of this disclosure. In another aspect (not shown), no quill is present.

The term "quill" as used herein is not limited to a component which directly extends from the top drive, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill."

As depicted, the drill string 155 typically includes interconnected sections of drill pipe 165, a bottom hole assembly (BHA) 170, and a drill bit 175. The BHA 170 may include stabilizers, drill collars, and/or measurement while drilling (MWD) tools or wireline conveyed instruments, among other components. The drill bit 175, which may also be referred to herein as a tool, is connected to the bottom of the BHA 170 or is otherwise attached to the drill string 155. One or more pumps 180 may deliver drilling fluid to the drill string 155 through a hose or other conduit 185, which may be fluidically and/or actually connected to the top drive 140.

The downhole MWD or wireline conveyed instruments may be configured for the evaluation of physical properties such as pressure, temperature, torque, weight-on-bit (WOB), vibration, inclination, azimuth, toolface orientation in three-dimensional space, and/or other downhole parameters. These measurements may be made downhole, stored in solid-state memory for some time, and downloaded from the instrument(s) at the surface and/or transmitted to the surface. Data transmission methods may include, for example, digitally encoding data and transmitting the encoded data to the surface, possibly as pressure pulses in the drilling fluid or mud system, acoustic transmission through the drill string 155, electronically transmitted through a wireline or wired pipe, and/or transmitted as electromagnetic (EM) pulses. MWD tools and/or other portions of the BHA 170 may have the ability to store measurements for later retrieval via wireline and/or when the BHA 170 is tripped out of the wellbore 160.

In certain examples, the BHA 170 can include a MWD communicator that provides EM transmission to a rig communicator located on the surface (e.g., within control system 190). In certain such or other examples, the transmissions may utilize phase shift key (PSK) telemetry. EM and/or PSK telemetry transmissions can be utilized at low or high frequencies. Such telemetry may consume more power when operated at higher data rates. As MWD tools can be battery powered and include finite energy, battery life and, thus, operational time of the MWD tool, can be adversely affected by transmitting a greater amount of data. Typically, there is an emphasis on providing faster transmissions that allow for greater amounts of data transmitted per unit time. However, such techniques tend to deplete battery life at greater levels, and use more power whether or not a battery is the energy source. Accordingly, the systems and techniques described herein allow for conservation of battery of MWD tools or minimized power usage and, thus, e.g., longer battery life. In certain embodiments, the systems and techniques allow for more regularly paced transmissions instead of bursts of data. For example, MWD data may be modified by TBS to slow down transmissions to a speed that conserves battery life and/or reduces power usage, but prevents disconnection between the MWD communicator and the rig communicator.

In an exemplary embodiment, the apparatus 100 may also include a rotating blow-out preventer (BOP) 158, such as if the well 160 is being drilled utilizing under-balanced or managed-pressure drilling methods. In such embodiment, the annulus mud and cuttings may be pressurized at the surface, with the actual desired flow and pressure possibly being controlled by a choke system, and the fluid and pressure being retained at the well head and directed down the flow line to the choke by the rotating BOP 158. The apparatus 100 may also include a surface casing annular pressure sensor 159 configured to detect the pressure in the annulus defined between, for example, the wellbore 160 (or casing therein) and the drill string 155.

In the exemplary embodiment depicted in FIG. 1, the top drive 140 is used to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig.

The apparatus 100 also includes a control system 190 configured to control or assist in the control of one or more components of the apparatus 100. For example, the control system 190 may be configured to transmit operational control signals to the drawworks 130, the top drive 140, the BHA 170 and/or the pump 180. The control system 190 may be a stand-alone component installed near the mast 105 and/or other components of the apparatus 100. In some embodiments, the control system 190 is physically displaced at a location separate and apart from the drilling rig.

The control system 190 is also configured to receive electronic signals via wired or wireless transmission techniques (also not shown in FIG. 1) from a variety of sensors and/or MWD tools included in the apparatus 100, where each sensor is configured to detect an operational characteristic or parameter. One such sensor is the surface casing annular pressure sensor 159 described above. The apparatus 100 may include a downhole annular pressure sensor **170*a* coupled to or otherwise associated with the BHA 170. The downhole annular pressure sensor 170*a* may be configured to detect a pressure value or range in the annulus-shaped region defined between the external surface of the BHA 170 and the internal diameter of the wellbore 160**, which may also be referred to as the casing pressure, downhole casing pressure, MWD casing pressure, or downhole annular pressure.

It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

The apparatus 100 may additionally or alternatively include a shock/vibration sensor **170*b* that is configured for detecting shock and/or vibration in the BHA 170. The apparatus 100 may additionally or alternatively include a mud motor delta pressure (ΔP) sensor 172***a* that is configured to detect a pressure differential value or range across one or more motors 172 of the BHA 170. The one or more motors 172 may each be or include a positive displacement drilling motor that uses hydraulic power of the drilling fluid to drive the bit 175, also known as a mud motor. One or more torque sensors 172*b* may also be included in the BHA 170 for sending data to the control system 190 that is indicative of the torque applied to the bit 175 by the one or more motors 172.

The apparatus 100 may additionally or alternatively include a toolface sensor 170*c* configured to detect the current toolface orientation. The toolface sensor 170*c* may be or include a conventional or future-developed "magnetic toolface" which detects toolface orientation relative to magnetic north or true north. Alternatively, or additionally, the toolface sensor 170*c* may be or include a conventional or future-developed "gravity toolface" which detects toolface orientation relative to the Earth's gravitational field. The toolface sensor 170*c* may also, or alternatively, be or include a conventional or future-developed gyro sensor. The apparatus 100 may additionally or alternatively include a WOB sensor 170*d* integral to the BHA 170 and configured to detect WOB at or near the BHA 170.

The apparatus 100 may additionally or alternatively include a torque sensor 140*a* coupled to or otherwise associated with the top drive 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140*b* configured to detect a value or range of the rotational speed of the quill 145.

The top drive 140, draw works 130, crown or traveling block, drilling line or dead line anchor may additionally or alternatively include or otherwise be associated with a WOB sensor 140*c* (e.g., one or more sensors installed somewhere in the load path mechanisms to detect WOB, which can vary from rig-to-rig) different from the WOB sensor 170*d*. The WOB sensor 140*c* may be configured to detect a WOB value or range, where such detection may be performed at the top drive 140, draw works 130, or other component of the apparatus 100.

The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection equipment may include one or more interfaces which may be local at the well/rig site or located at another, remote location with a network link to the system.

Figure 2:
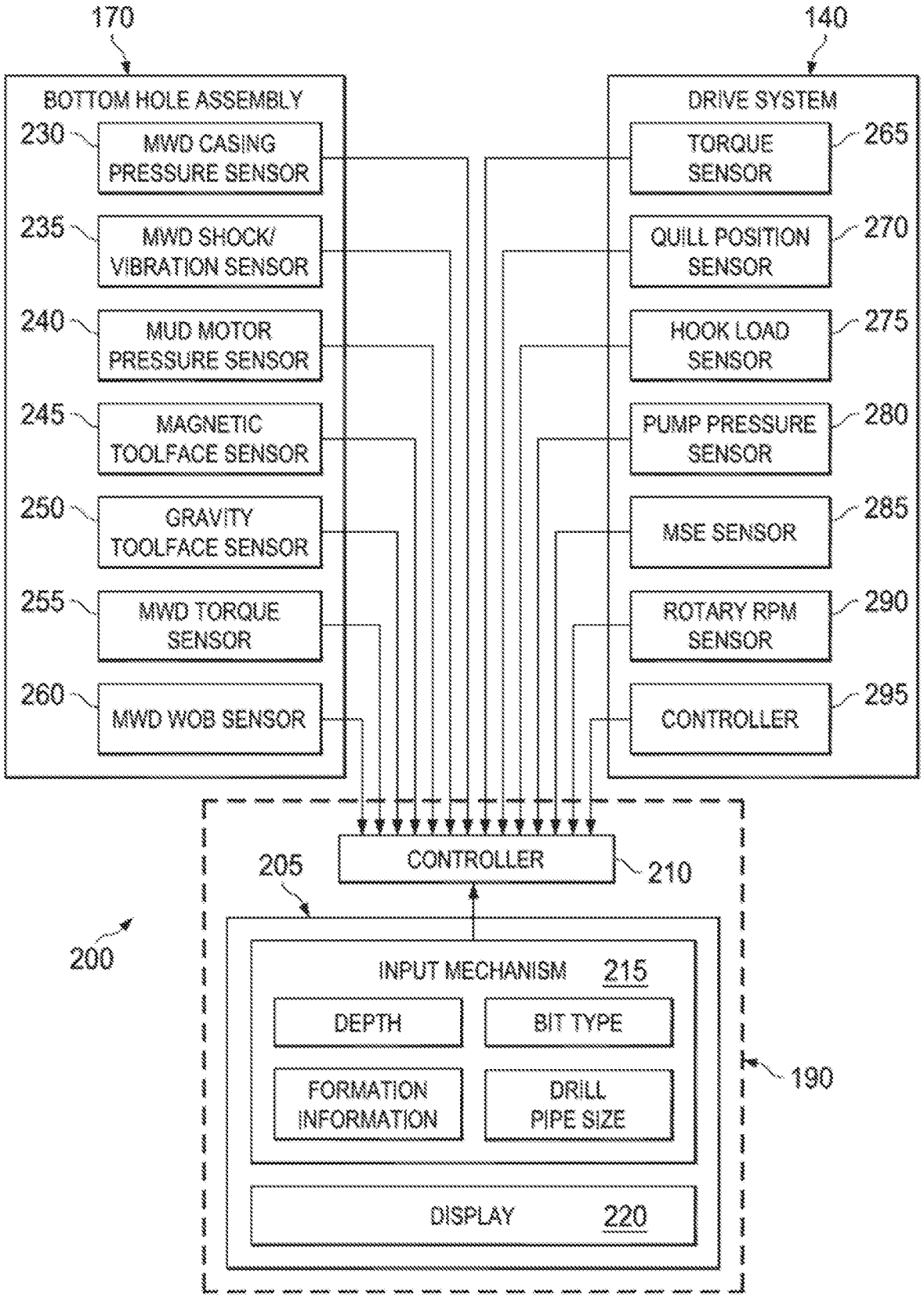
FIG. 2 is a block diagram schematic of an apparatus according to one or more aspects of the present disclosure.

FIG. 2 illustrates a block diagram of a portion of an apparatus 200 according to one or more aspects of the present disclosure. FIG. 2 shows the control system 190, the BHA 170, and the top drive 140, identified as a drive system. The apparatus 200 may be implemented within the environment and/or the apparatus shown in FIG. 1.

The control system 190 includes a user-interface 205 and a controller 210. Depending on the embodiment, these may be discrete components that are interconnected via wired or wireless technique. Alternatively, the user-interface 205 and the controller 210 may be integral components of a single system.

The user-interface 205 may include an input mechanism 215 permitting a user to input a left oscillation revolution setting and a right oscillation revolution setting. These settings control the number of revolutions of the drill string as the system controls the top drive (or other drive system) to oscillate a portion of the drill string from the top. In some embodiments, the input mechanism 215 may be used to input additional drilling settings or parameters, such as acceleration, toolface set points, rotation settings, and other set points or input data, including a torque target value, such as a previously calculated torque target value, that may determine the limits of oscillation. A user may input information relating to the drilling parameters of the drill string, such as BHA information or arrangement, drill pipe size, bit type, depth, formation information. The input mechanism 215 may include a keypad, voice-recognition apparatus, dial, button, switch, slide selector, toggle, joystick, mouse, data base and/or any other data input device available at any time to one of ordinary skill in the art. Such an input mechanism 215 may support data input from local and/or remote locations. Alternatively, or additionally, the input mechanism 215, when included, may permit user-selection of predetermined profiles, algorithms, set point values or ranges, such as via one or more drop-down menus. The data may also or alternatively be selected by the controller 210 via the execution of one or more database look-up procedures. In general, the input mechanism 215 and/or other components within the scope of the present disclosure support operation and/or monitoring from stations on the rig site as well as one or more remote locations with a communications link to the system, network, local area network (LAN), wide area network (WAN), Internet, satellite-link, and/or radio, among other techniques or systems available to those of ordinary skill in the art.

The user-interface 205 may also include a display 220 for visually presenting information to the user in textual, graphic, or video form. The display 220 may also be utilized by the user to input drilling parameters, limits, or set point data in conjunction with the input mechanism 215. For example, the input mechanism 215 may be integral to or otherwise communicably coupled with the display 220.

In one example, the controller 210 may include a plurality of pre-stored selectable oscillation profiles that may be used to control the top drive or other drive system. The pre-stored selectable profiles may include a right rotational revolution value and a left rotational revolution value. The profile may include, in one example, 5.0 rotations to the right and −3.3 rotations to the left. These values are preferably measured from a central or neutral rotation.

In addition to having a plurality of oscillation profiles, the controller 210 includes a memory with instructions for performing a process to select the profile. In some embodiments, the profile is a simply one of either a right (i.e., clockwise) revolution setting and a left (i.e., counterclockwise) revolution setting. Accordingly, the controller 210 may include instructions and capability to select a pre-established profile including, for example, a right rotation value and a left rotation value. Because some rotational values may be more effective than others in particular drilling scenarios, the controller 210 may be arranged to identify the rotational values that provide a suitable level, and preferably an optimal level, of drilling speed. The controller 210 may be arranged to receive data or information from the user, the bottom hole assembly 170, and/or the top drive 140 and process the information to select an oscillation profile that might enable effective and efficient drilling.

The BHA 170 may include one or more sensors, typically a plurality of sensors, located and configured about the BHA to detect parameters relating to the drilling environment, the BHA condition and orientation, and other information. In the embodiment shown in FIG. 2, the BHA 170 includes an MWD casing pressure sensor 230 that is configured to detect an annular pressure value or range at or near the MWD portion of the BHA 170. The casing pressure data detected via the MWD casing pressure sensor 230 may be sent via electronic signal to the controller 210 via wired or wireless transmission.

The BHA 170 may also include an MWD shock/vibration sensor 235 that is configured to detect shock and/or vibration in the MWD portion of the BHA 170. The shock/vibration data detected via the MWD shock/vibration sensor 235 may be sent via electronic signal to the controller 210 via wired or wireless transmission.

The BHA 170 may also include a mud motor ΔP sensor 240 that is configured to detect a pressure differential value or range across the mud motor of the BHA 170. The pressure differential data detected via the mud motor ΔP sensor 240 may be sent via electronic signal to the controller 210 via wired or wireless transmission. The mud motor ΔP may be alternatively or additionally calculated, detected, or otherwise determined at the surface, such as by calculating the difference between the surface standpipe pressure just off-bottom and pressure once the bit touches bottom and starts drilling and experiencing torque.

The BHA 170 may also include a magnetic toolface sensor 245 and a gravity toolface sensor 250 that are cooperatively configured to detect the current toolface. The magnetic toolface sensor 245 may be or include a conventional or future-developed magnetic toolface sensor which detects toolface orientation relative to magnetic north or true north. The gravity toolface sensor 250 may be or include a conventional or future-developed gravity toolface sensor which detects toolface orientation relative to the Earth's gravitational field. In an exemplary embodiment, the magnetic toolface sensor 245 may detect the current toolface when the end of the wellbore is less than about 7° from vertical, and the gravity toolface sensor 250 may detect the current toolface when the end of the wellbore is greater than about 7° from vertical. However, other toolface sensors may also be utilized within the scope of the present disclosure that may be more or less precise or have the same degree of precision, including non-magnetic toolface sensors and non-gravitational inclination sensors. In any case, the toolface orientation detected via the one or more toolface sensors (e.g., sensors 245 and/or 250) may be sent via electronic signal to the controller 210 via wired or wireless transmission.

The BHA 170 may also include an MWD torque sensor 255 that is configured to detect a value or range of values for torque applied to the bit by the motor(s) of the BHA 170. The torque data detected via the MWD torque sensor 255 may be sent via electronic signal to the controller 210 via wired or wireless transmission.

The BHA 170 may also include an MWD weight-on-bit (WOB) sensor 260 that is configured to detect a value or range of values for WOB at or near the BHA 170. The WOB data detected via the MWD WOB sensor 260 may be sent to the controller 210 via one or more signals, such as one or more electronic signals (e.g., wired or wireless transmission) or mud pulse telemetry, or any combination thereof.

The top drive 140 may also or alternatively include one or more sensors or detectors that provide information that may be considered by the controller 210 when it selects the oscillation profile. In this embodiment, the top drive 140 includes a rotary torque sensor 265 that is configured to detect a value or range of the reactive torsion of the quill 145 or drill string 155. The top drive 140 also includes a quill position sensor 270 that is configured to detect a value or range of the rotational position of the quill, such as relative to true north or another stationary reference. The rotary torque and quill position data detected via sensors 265 and 270, respectively, may be sent via electronic signal to the controller 210 via wired or wireless transmission.

The top drive 140 may also include a hook load sensor 275, a pump pressure sensor or gauge 280, a mechanical specific energy (MSE) sensor 285, and a rotary RPM sensor 290.

The hook load sensor 275 detects the load on the hook 135 as it suspends the top drive 140 and the drill string 155. The hook load detected via the hook load sensor 275 may be sent via electronic signal to the controller 210 via wired or wireless transmission.

The pump pressure sensor or gauge 280 is configured to detect the pressure of the pump providing mud or otherwise powering the BHA from the surface. The pump pressure detected by the pump sensor pressure or gauge 280 may be sent via electronic signal to the controller 210 via wired or wireless transmission.

The mechanical specific energy (MSE) sensor 285 is configured to detect the MSE representing the amount of energy required per unit volume of drilled rock. In some embodiments, the MSE is not directly sensed, but is calculated based on sensed data at the controller 210 or other controller about the apparatus 100.

The rotary RPM sensor 290 is configured to detect the rotary RPM of the drill string. This may be measured at the top drive or elsewhere, such as at surface portion of the drill string. The RPM detected by the RPM sensor 290 may be sent via electronic signal to the controller 210 via wired or wireless transmission.

In FIG. 2, the top drive 140 also includes a controller 295 and/or other device for controlling the rotational position, speed and direction of the quill 145 or other drill string component coupled to the top drive 140 (such as the quill 145 shown in FIG. 1). Depending on the embodiment, the controller 295 may be integral with or may form a part of the controller 210.

The controller 210 is configured to receive detected information (i.e., measured or calculated) from the user-interface 205, the BHA 170, and/or the top drive 140, and utilize such information to continuously, periodically, or otherwise operate to determine and identify an oscillation regime target, such as a target rotation parameter having improved effectiveness. The controller 210 may be further configured to generate a control signal, such as via intelligent adaptive control, and provide the control signal to the top drive 140 to adjust and/or maintain the oscillation profile to most effectively perform a drilling operation. Consequently, the controller 295 of the top drive 140 may be configured to modify the number of rotations in an oscillation, the torque level threshold, or other oscillation regime target. It should be understood the number of rotations used at any point in the present disclosure may be a whole or fractional number.

Figure 3:
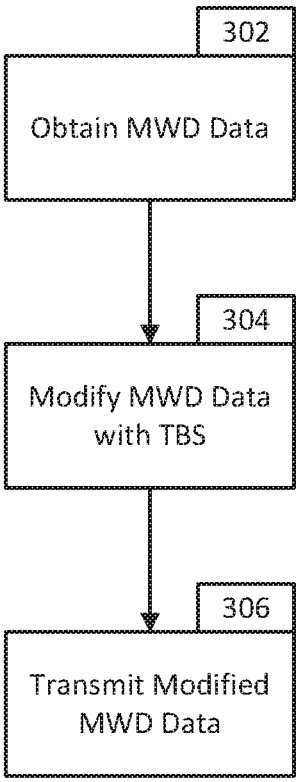
FIG. 3 is a flow-chart diagram detailing at least a portion of a method according to one or more aspects of the present disclosure.

FIG. 3 is a flow-chart diagram detailing at least a portion of a method according to one or more aspects of the present disclosure. FIG. 3 may illustrate a technique of transmitting MWD data that conserves battery life of a BHA. FIG. 3 illustrates an example technique where MWD data may be modified with TBS to allow for battery savings and/or general reduction in power usage.

In block 302, MWD data is obtained by the BHA. The MWD data may be, for example, data related to downhole drilling conditions, orientation of the BHA, drilling progress, and/or other data associated with the BHA and/or drilling operations. Some or all of the MWD data may be configured to be transmitted to the surface (e.g., to a control station at the surface).

In block 304, the MWD data may be modified with TBS. Such modification may lengthen the transmission time of MWD data while conserving battery life or otherwise reducing power consumption. For example, such TBS may cause a delay between transmission of various portions of the MWD data. Examples of such TBS may, for example, include additional spaces, blanks, or other symbols between portions of MWD data. Such spaces, blanks, or other symbols may not be transmitted (e.g., may not cause transmission of data from the MWD communicator to the rig communicator) and, thus, may not consume battery life, or may consume only minimal amounts of battery life or power. Modifying the MWD data to lengthen the time of transmission may, for example, decrease or eliminate data transmitted or re-transmitted to simply maintain connection or verify transmission between the MWD communicator and the rig communicator and/or may allow for operation of the MWD communicator at a slower and less power intensive transmission speed.

In block 306, the modified MWD data may be communicated. For example, after the controller of the BHA has modified the MWD data in block 306, a downhole transmitter (e.g., a transmitter of the MWD communicator) may communicate the modified MWD data to a receiver (e.g., a receiver of the rig communicator). The receiver may be disposed on the surface and/or be a part of the controller of the rig that controls operation of the BHA and/or be disposed in an adjacent well with the receiver being connected by wireline to the surface. Operation of the rig may then be controlled or adjusted according to the modified MWD data.

Figure 4:
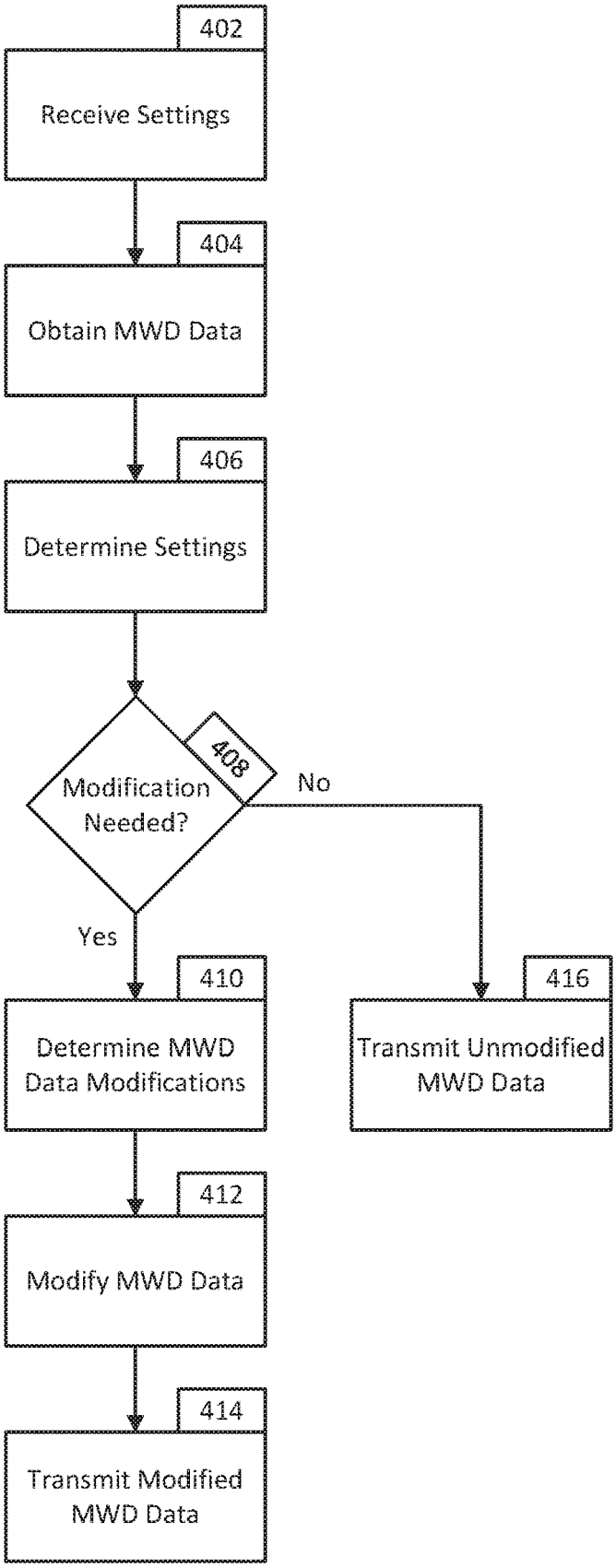
FIG. 4 is a flow-chart diagram detailing further aspects of at least a portion of a method according to one or more aspects of the present disclosure.

FIG. 4 is a flow-chart diagram detailing further aspects of at least a portion of a method according to one or more aspects of the present disclosure. FIG. 4 further details the technique of modifying MWD data to conserve battery life and/or otherwise reduce power consumption of a BHA as illustrated in FIG. 3. The techniques described in FIGS. 3 and 4 may be performed by any component of a BHA, such as a controller located on the BHA as well as a MWD communicator of the BHA.

In block 402, settings may be received. Such settings may be, for example, settings for obtaining data by one or more sensors of the BHA as well as settings for communication of data between the MWD communicator and the rig communicator. In certain embodiments, the MWD tool of the BHA transmits data according to the settings received from the controller (e.g., controller at the surface) and cannot modify telemetry in manners not specified in the settings. Thus, the MWD tool cannot modify MWD data, or transmission settings for communicating MWD data thereof, in ways not allowed by the settings, as such modifications may render the rig communicator unable to receive and/or decode MWD data from the MWD communicator.

In block 404, the MWD data may be obtained. The MWD data may be obtained in block 404 in a manner similar to that detailed for block 302 of FIG. 3. In block 406, settings of the MWD tool are determined. Such settings can include settings for transmission of MWD data from the MWD communicator to the rig communicator (e.g., the frequency, speed, power, and/or other settings used in such transmissions). Such settings may include settings directed to TBS (e.g., the maximum amount of TBS allowed between bits of data or when TBS use is permitted). Such transmission settings may form the baseline for any modified MWD data. That is, though the MWD data may be modified with TBS, the resulting modifications will still be according to the settings and, thus, will not violate the settings specified.

Additionally, the time of the last update to the settings can also be determined. In certain embodiments, if the settings have been recently updated, the controller and/or MWD communicator may be more unlikely to modify the MWD data, while more out of date settings (e.g., if the settings are older than a threshold age) may lead to the controller and/or MWD communicator modifying and/or being more likely to modify the MWD data.

In block 408, whether the MWD data should be modified is determined. The determinations of blocks 402, 406, as well as other factors, may be used to determine whether modification is needed. If modification is not needed, the unmodified MWD data may be transmitted to the rig communicator in block 416. If the MWD data is to be modified, the process may proceed to block 410.

In block 410, modifications for the MWD data may be determined and the MWD data may be modified in block 412. For example, the MWD data may be modified with TBS inserted between a first MWD data portion and a second MWD data portion. Such data portions may be a first telemetry symbol and a second telemetry symbol, each telemetry symbol configured to indicate a measurement by the MWD tool. The TBS may delay transmission of the second MWD data portion after the first MWD data portion and, accordingly, increase the amount of time needed to transmit the modified MWD data.

Such TBS may, for example, be "spaces" between data portions as well as other symbols and/or data that decrease transmission speeds. In certain embodiments, such symbols and/or data may cause the MWD communicator to pause transmitting for a period of time. The TBS may be configured so that such a period of time is less than an amount of time that would cause the MWD communicator and the rig communicator to disconnect from each other, to maintain connection between the MWD communicator and the rig communicator. In other embodiments, the TBS may modify the MWD data so that transmission of the modified MWD data is effectively at a desired rate of transmission that is slower than the other settings of the MWD tool would permit.

In certain embodiments, the MWD communicator and rig communicator may communicate data and/or settings through a communication technique that allows for modification of MWD data with TBS. The rig communicator in such a technique may, for example, recognize that "spaces" or another symbol is specifically inserted by the MWD data to pause and/or delay transmission (e.g., may indicate that the MWD communicator should delay transmission by 5 seconds). The MWD communicator may then delay transmission according to the space and/or symbol, which may be inserted by the MWD communicator, the rig communicator, a controller, or another device. In certain such embodiments, the rig communicator may be accordingly configured to accommodate such delays. For example, the rig communicator may be configured to maintain a connection with the MWD communicator despite pauses in transmission of data. Thus, the MWD communicator may be configured to, for example, insert spaces causing a maximum delay of 20 seconds between symbols. The rig communicator may accordingly be configured to, for example, maintain a connection for 20 seconds or longer despite receiving no data from the MWD communicator. The rig communicator may, thus, be configured to accommodate the maximum delay that may be inserted between symbols.

Decreasing the speed of transmission of modified MWD data may result in the MWD communicator operating at lower power outputs, decrease the amount of "maintenance" transmissions that are needed to maintain a connection (e.g., using a handshake sequence, or retransmitting a portion of the data to verify receipt by the rig communicator), decrease the power requirements of secondary systems (e.g., cooling systems), and/or conserve battery in other manners. The modified MWD data may be transmitted to the rig communicator in block 414. By using the systems and method described herein, a MWD tool can transmit data at lower power levels without changing transmission settings.

Figure 5A:
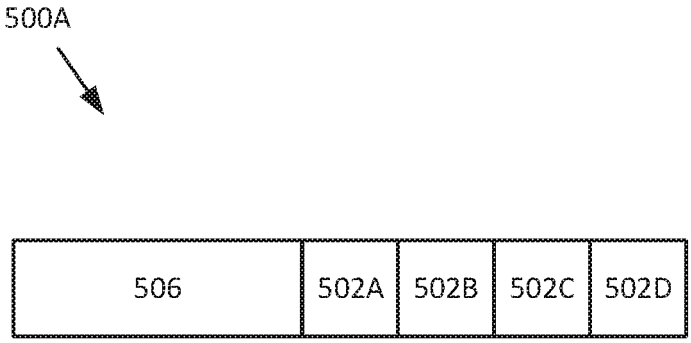
FIGS. 5A and 5B are block diagram schematics of MWD data according to one or more aspects of the present disclosure.
Figure 5B:
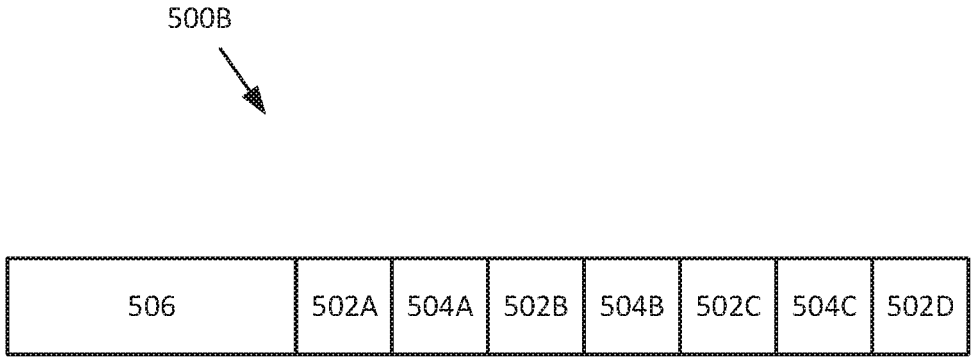

FIGS. 5A and 5B are block diagram schematics of MWD data according to one or more aspects of the present disclosure. FIG. 5A illustrates MWD data 500A that does not include TBS while FIG. 5B illustrates MWD data 500B that has been modified with TBS.

MWD data 500A includes synchronization block 506 and data bits 502A-D. As illustrated, MWD data 500A can be transmitted by a MWD tool in a first timeframe. Meanwhile, MWD data 500B includes synchronization block 506, data bits 502A-D, and TBS 504A-C. TBS 504A is inserted between data bits 502A and 502B, TBS 504B is inserted between data bits 502B and 502C, and TBS 504C is inserted between data bits 502C and 502D. Inserting TBS 504A-C between data bits 502A-D increases the transmission time of MWD data 500B without modifying the substance of MWD data 500B. Thus, MWD data 500B can be transmitted by a MWD tool in a second timeframe longer than the first timeframe. Accordingly, insertion of TBS 504A-C can decrease the effective transmission rate of the MWD data.

As described herein, "MWD tool," "MWD communicator," and "transmitter" may refer to any portion of the BHA that is configured to determine or receive MWD data, communicate MWD data to a controller on the surface or on the rig, and/or perform other operations associated with the processing or communication of MWD data. The MWD tool, MWD communicator, and/or the transmitter may include one or more controllers and/or transmitting/receiving devices. "Receiver," "rig communicator," and "rig controller" may refer to any portion of the rig and/or control systems configured to receive the MWD data and/or provide settings that govern operation of the MWD tool, transmitter, or other aspect of the BHA. The rig controller, rig communicator, and/or receiver may also include one or more controllers and/or transmitting/receiving devices.

In view of all of the above and the figures, one of ordinary skill in the art will readily recognize that the present disclosure introduces an apparatus that may include a measurement while drilling (MWD) sensor and a MWD communicator communicatively coupled to the MWD sensor, synchronized to a rig communicator to provide data to the rig communicator according to transmission settings. The MWD communicator may be configured to receive MWD data from the MWD sensor, determine that a transmission setting for providing the MWD data from the MWD communicator to the rig communicator, modify the MWD data with time between symbols (TBS) such that the transmission time, according to the transmission settings, for providing the MWD data is increased, and transmit the MWD data from the MWD communicator to the rig communicator according to the modifications increasing the transmission time.

In an aspect of the invention, the TBS may include one or more spaces, blanks, or both.

In another aspect of the invention, the TBS may be shorter than a de-synchronization timeframe between the MWD communicator and the rig communicator.

In another aspect of the invention, the MWD sensor and the MWD communicator are disposed on a downhole drilling tool. In certain such aspects of the invention, the apparatus may further include the rig communicator. In certain such aspects of the invention, the transmission settings are changeable via a settings update received from the rig communicator, and the MWD communicator may be configured to modify the MWD data to increase the transmission time in response to not receiving the settings update for a threshold time period.

In another aspect of the invention, a method may be introduced that may include receiving measurement while drilling (MWD) data from a MWD sensor with a MWD communicator, determining that the MWD data will be provided from the MWD communicator to a rig communicator synchronized with the MWD communicator in a first time amount, determining that the first time amount is less than an allowable time amount, modifying the MWD data with time between symbols (TBS) such that the MWD data will be provided from the MWD communicator to the rig communicator in a second time amount greater than the first time amount; and transmitting the MWD data from the MWD communicator to the rig communicator in the second time amount according to the modifications.

In an aspect of the invention, the TBS may include one or more spaces, blanks, or both.

In another aspect of the invention, the second time amount may be less than the allowable timeframe.

In another aspect of the invention, the second time amount may be substantially equal to the allowable timeframe.

In another aspect of the invention, the TBS may be configured to avoid de-synchronization between the MWD communicator and the rig communicator.

In another aspect of the invention, the MWD communicator may be disposed on a downhole drilling tool.

In another aspect of the invention, a system may be introduced that may include a drilling rig comprising a rig communicator, a drilling tool coupled to the drilling rig and comprising at least one measurement while drilling (MWD) sensor, and a MWD communicator communicatively coupled to the MWD sensor, synchronized to the rig communicator to provide data to the rig communicator according to transmission settings. The MWD communicator may be configured to receive MWD data from the MWD sensor, determine that a first transmission time for providing the MWD data from the MWD communicator to the rig communicator, according to the transmission settings, is less than an allowable timeframe, modify the MWD data with time between symbols (TBS) such that, according to the transmission settings, providing the MWD data is within a second transmission time greater than the first transmission time, and transmit the modified MWD data from the MWD communicator to the rig communicator.

In an aspect of the invention, the rig communicator and the MWD communicator may be configured to include matching transmission settings for the MWD communicator to provide data to the rig communicator. In an aspect of such an invention, the transmission settings may be changeable via a settings update communicated from the rig communicator to the MWD communicator. In an aspect of such an invention, the MWD communicator may be configured to modify the MWD data in response to not receiving the settings update for a threshold time period.

In another aspect of the invention, the TBS include one or more spaces, blanks, or both.

In another aspect of the invention, the second transmission time may be less than the allowable timeframe.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The term "and/or," as used herein, is intended to refer separately to each item in a list, or any combination thereof.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. An apparatus comprising:

a measurement while drilling (MWD) sensor; and an MWD communicator communicatively coupled to the MWD sensor, synchronized to a rig communicator to provide data to the rig communicator according to transmission settings, and configured to:

receive MWD data from the MWD sensor, wherein the MWD data comprises a plurality of data bits;

determine that a transmission time for providing the MWD data from the MWD communicator to the rig communicator, according to the transmission settings, is less than an allowable timeframe;

modify the MWD data by inserting time between symbols (TBS) between the plurality of data bits such that the transmission time, according to the transmission settings, for providing the MWD data is increased, wherein the TBS causes a delay of at least 5 seconds between the plurality of data bits; and transmit the MWD data from the MWD communicator to the rig communicator according to the modifications increasing the transmission time.

2. The apparatus of claim 1, wherein the TBS comprises one or more spaces and/or blanks.

3. The apparatus of claim 1, wherein the increased transmission time is less than the allowable timeframe.

4. The apparatus of claim 1, wherein the TBS is shorter than a de-synchronization timeframe between the MWD communicator and the rig communicator.

5. The apparatus of claim 1, wherein the MWD sensor and the MWD communicator are disposed on a downhole drilling tool.

6. The apparatus of claim 5, further comprising the rig communicator.

7. The apparatus of claim 6, wherein the rig communicator is disposed on a surface.

8. The apparatus of claim 1, wherein the transmission settings are changeable via a settings update received from the rig communicator, and wherein the MWD communicator is configured to modify the MWD data to increase the transmission time in response to not receiving the settings update for a threshold time period.

9. A method comprising:

receiving measurement while drilling (MWD) data from a MWD sensor with a MWD communicator, wherein the MWD data comprises a plurality of data bits;

determining that the MWD data will be provided from the MWD communicator to a rig communicator synchronized with the MWD communicator in a first time amount;

determining that the first time amount is less than an allowable time amount;

modifying the MWD data by inserting time between symbols (TBS) between the plurality of data bits such that the MWD data will be provided from the MWD communicator to the rig communicator in a second time amount greater than the first time amount, wherein the TBS causes a delay of at least 5 seconds; and transmitting the MWD data from the MWD communicator to the rig communicator in the second time amount according to the modifications.

10. The method of claim 9, wherein the TBS comprises one or more spaces, blanks, or both.

11. The method of claim 9, wherein the second time amount is less than the allowable time amount.

12. The method of claim 9, wherein the second time amount is substantially equal to the allowable time amount.

13. The method of claim 9, wherein the TBS is configured to avoid de-synchronization between the MWD communicator and the rig communicator.

14. The method of claim 9, wherein the MWD communicator is disposed on a downhole drilling tool.

15. A system comprising:

a drilling rig comprising a rig communicator;

a drilling tool coupled to the drilling rig and comprising at least one measurement while drilling (MWD) sensor; and a MWD communicator communicatively coupled to the MWD sensor, synchronized to the rig communicator to provide data to the rig communicator according to transmission settings, and configured to:

receive MWD data from the MWD sensor, wherein the MWD data comprises a plurality of data bits;

determine that a first transmission time for providing the MWD data from the MWD communicator to the rig communicator, according to the transmission settings, is less than an allowable timeframe;

modify the MWD data by inserting time between symbols (TBS) between the plurality of data bits such that, according to the transmission settings, providing the MWD data is within a second transmission time greater than the first transmission time, wherein the TBS causes a delay of at least 5 seconds between the plurality of data bits; and transmit the modified MWD data from the MWD communicator to the rig communicator.

16. The system of claim 15, wherein the rig communicator and the MWD communicator are configured to include matching transmission settings for the MWD communicator to provide data to the rig communicator.

17. The system of claim 16, wherein the transmission settings are changeable via a settings update communicated from the rig communicator to the MWD communicator.

18. The system of claim 17, wherein the MWD communicator is configured to modify the MWD data in response to not receiving the settings update for a threshold time period.

19. The system of claim 15, wherein the TBS comprises one or more spaces, blanks, or both.

20. The system of claim 15, wherein the second transmission time is less than the allowable timeframe.

* * * * *